US007430974B2

(12) United States Patent
Sho et al.

(10) Patent No.: US 7,430,974 B2
(45) Date of Patent: Oct. 7, 2008

(54) FLY SEWING MACHINE

(75) Inventors: Yoshiyuki Sho, Kennesaw, GA (US); Harumi Takagishi, Toyama-ken (JP)

(73) Assignee: YKK Corporation, Tokyo (JP)

( * ) Notice: Subject to any disclaimer, the term of this patent is extended or adjusted under 35 U.S.C. 154(b) by 363 days.

(21) Appl. No.: 11/294,020

(22) Filed: Dec. 5, 2005

(65) Prior Publication Data

US 2006/0144309 A1 Jul. 6, 2006

(30) Foreign Application Priority Data

Dec. 8, 2004 (JP) ..... 2004-355382

(51) Int. Cl.
*D05B 27/10* (2006.01)
*D05B 35/02* (2006.01)

(52) U.S. Cl. ..... 112/470.33; 112/304

(58) Field of Classification Search ..... 112/470.03, 112/470.33, 303, 304, 318, 320, 322, 475.16
See application file for complete search history.

(56) References Cited

U.S. PATENT DOCUMENTS 3,570,104 A 3/1971 Jensen
4,362,116 A * 12/1982 Sen Gupta et al. ..... 112/470.03
4,576,104 A 3/1986 Miyakawa
4,608,745 A 9/1986 Miyakawa et al.
4,611,546 A * 9/1986 Miyakawa ..... 112/470.33
5,067,424 A * 11/1991 Ishikawa et al. ..... 112/307
5,161,474 A 11/1992 Ishikawa et al.
5,701,833 A * 12/1997 Suzuki ..... 112/475.16

FOREIGN PATENT DOCUMENTS

EP 0173247 11/1989
JP 63-9878 3/1988

* cited by examiner

*Primary Examiner*—Ismael Izaguirre
(74) *Attorney, Agent, or Firm*—Alston & Bird LLP

(57) ABSTRACT

A fly sewing machine comprising a fly carrying portion disposed on an upstream side of a fly carrying passage between a fly supply portion and a sewing machine and a carrying speed adjusting portion disposed on a downstream side is disclosed. The fly carrying portion comprises a plurality of carrying roller pairs having driver rollers and supporting rollers disposed vertically opposite each other, and the carrying speed adjusting portion comprises a pair of a drive roller and a supporting roller disposed vertically and roller gap adjusting means for adjusting a gap between the drive roller and the supporting roller By the time a following fly carried from the fly carrying portion is bitten into the gap between the drive roller and the supporting roller of the carrying speed adjusting portion, a predetermined interval is formed between a preceding fly and the following fly.

7 Claims, 7 Drawing Sheets

FLY SEWING MACHINE

BACKGROUND OF THE INVENTION

1. Field of the Invention

The present invention relates to a fly sewing machine for sewing plural flies made of fabric piece such as flies of trousers to a long slide fastener chain continuously.

2. Description of the Related Art

A machine for sewing plural flies to a long slide fastener chain has been disclosed in, for example, Japanese Patent Application Publication (JP-B) No. 63-009878. According to this machine, each fly is supplied to that sewing machine successively through a supply section. A series of flies are carried to the sewing machine by the supply section such that they are arranged in order in conditions in which ends thereof keep contact with each other even if lengths of the flies are different, and sewed successively. The supply section includes plural pairs of drive rollers and supporting rollers which constitute a driving nipper, so that a series of flies carried to the supply section are sent by the driving nipper. One of the drive rollers that is located on an uppermost upstream side rotates fastest and carrying speed decreases as it goes to a downstream side. Further, rotation speed of the drive roller located on a bottommost downstream side is set higher than sewing speed of the sewing machine. As a consequence, before sewing operation of a preceding fly is completed, a front end of a following fly arrives at a rear end of the preceding fly.

A supporting roller is installed to a housing having a guide surface in which a gap of a specified size is formed and urged against an opposing drive roller slightly, so that it carries each fly by a guide of the gap. By passing the fly through this gap, the front end of a following fly is protected from being bent or overlapping the rear end of a preceding fly, so that it can make contact with the rear end of the preceding fly.

Fabrics having various thicknesses from a relatively thick fabric (denim for jeans) to a thin fabric. The sewing machine disclosed in JP-B No. 63-009878 can sew flies composed of same fabric continuously by sending a following fly such that it overtakes the rear end of a preceding fly and making contact therewith. On the other hand, a sewing workshop is demanded to sew a series of flies to a long slide fastener chain using a same sewing machine regardless of the thickness of fabric of the flies. However, if gaps formed vertically in a fly carrying passage are unchanged when it is intended to continuously sew flies composed of various thicknesses as described previously, when the front end of a following fly makes contact with the rear end of a preceding fly, the front end of the following fly overlap the preceding fly or an end section in contact is folded.

To prevent this, the gap in a vertical direction of the fly carrying passage needs to be adjusted corresponding to the thickness of a fabric. Executing this adjustment of the gap each time when the thickness of fabric changes leads to complicate a preparatory work for sewing, which never goes along with the above-described demand for the sewing workshop. Further, unless the adjustment of the gap is carried out accurately corresponding to the thickness of fabric, the front end of the following fly may overtake and ride over the preceding fly or the end section in contact may be folded. Further, if a kind of the fly changes, the carrying speed of the fly also changes, because friction of the fabric surface changes depending on a difference of weaving of fabric. To meet this change of friction, a difference in rotation speed between respective drive rollers disposed in a fly supply section needs to be adjusted with high accuracy. In recent years in which a trousers sewing manufacturer handles sewing work of multiple kinds of fabrics, it has been highly demanded to shorten adjustment time for a unit required at a time of fabric change-over as much as possible.

Further, it is difficult for the fly sewing machine disclosed in JP-B No. 63-009878 to sew a curved fly after serging with an end portion cut into a circular shape and serged. That is, although the sewing machine of JP-B No. 63-009878 sews flies continuously since end surfaces thereof kept in contact with each other after a following fly catches up with a preceding fly, it is very difficult to sew flies whose contact end is not linear like the curved fly continuously to a fastener chain in a condition in which they are in contact with each other because the carrying direction changes when the flies are carried. Further, because a thickness of a thread is added to a serged portion, it comes that a difference occurs in thickness between the serged portion and fabric main body. In a condition in which a difference exists in thickness of the fabric of a single fly, the carrying speed cannot be kept constant, so that flies cannot be carried continuously in a stable condition such that they are kept in contact with each other or sewed down.

SUMMARY OF THE INVENTION

The present invention has been achieved to solve the above-described problem and a specific object of the invention is to provide a fly sewing machine having a fly carrying unit capable of preparing for sewing with a simple adjustment mechanism even if a thickness of fabric changes and sewing not only ordinary flies but also curved flies continuously in an arranged condition and adjusting an interval between a preceding fly and a following fly to be sewed down easily.

The above-described object is achieved by a fly sewing machine, as a main structure of the invention, for sewing plural flies made of fabric piece to a long slide fastener chain continuously, wherein the fly sewing machine comprises a fly carrying portion disposed on an upstream side of a fly carrying passage between a fly supply portion and a sewing machine and a carrying speed adjusting portion disposed on a downstream side, wherein the fly carrying portion has plural pairs of carrying rollers including drive rollers and supporting rollers disposed vertically so as to oppose to each other and wherein the carrying speed adjusting portion has a drive roller and a supporting roller, making a pair at upper and lower positions, and roller gap adjusting means for adjusting a gap between the drive roller and the supporting roller.

Preferably, the supporting rollers of the fly carrying portion and the supporting roller of the carrying speed adjusting portion are urged elastically against opposing drive rollers and an urging force of the carrying speed adjusting portion to the supporting roller is set to 8 to 40 times as large as an urging force of the fly carrying portion to the supporting rollers.

Further, preferably, carrying speed for the fly by each pair of the carrying rollers is same, carrying speed of the carrying speed adjusting portion is set lower than carrying speed of the fly carrying portion and sewing speed of the sewing machine is set lower than the carrying speed of the carrying speed adjusting portion. Further, a photoelectric detector for maintaining drive of the sewing machine when beam is intercepted and stopping the drive of the sewing machine when beam is transmitted may be disposed between the fly carrying portion and the carrying speed adjusting portion. Preferably, a diameter of the drive roller in the carrying speed adjusting portion is set larger than a diameter of the supporting roller. Further, the drive rollers and supporting rollers used in the fly carrying portion are preferred to be smooth rollers and at a same time, peripheral surfaces of the drive roller and supporting roller of the carrying speed adjusting portion are preferred to be formed into high friction surfaces.

Preferably, the roller gap adjusting means can adjust the gap between the drive roller and the supporting roller of the carrying speed adjusting portion so as to be smaller than a fabric thickness of the fly.

Preferably, a chain feeding portion for feeding the long slide fastener chain to the sewing portion is disposed between the carrying speed adjusting portion and the sewing portion, the chain feeding portion comprises a chain feed roller portion having a drive roller for supplying and sending the long slide fastener chain, and the drive roller of the carrying speed adjusting portion is driven and rotated synchronously with a drive of the drive roller of the chain feed roller portion.

By adjusting a gap between the drive roller and supporting roller of the carrying speed adjusting portion corresponding to a thickness of fabric, the fly can be carried such that it is securely sandwiched between upper and lower rollers even if the thickness of the fabric of the fly changes. Thus, no loss occurs due to slippage during transportation, so that continuous sewing can be executed at constant speed.

If the gap between the drive roller and the supporting roller in the carrying speed adjusting portion is adjusted to be smaller than the thickness of fabric, a fly carried on the carrying passage from the upstream side collides with the supporting roller first of all. After that, the fly is pressed against the opposing drive roller and bitten by the upper and lower rollers so that it is carried aggressively. At this time, if the diameter of the supporting roller is set smaller than the diameter of the drive roller, it becomes more difficult for the fly to get into the gap between both rollers. Thus, by a time when the fly is carried such that it is sandwiched between the supporting roller and the drive roller, an instantaneous stop time is generated in the fly. If the diameter of the supporting roller is set to about ⅔ of the diameter of the drive roller, the stop time can be secured. An interval is generated between a preceding fly and a following fly by an amount corresponding to this stop time, so that the transportation of a following fly to the sewing machine can be delayed.

In recent years, sewing workshops have various desires, that is, some workshop desires a condition in which the preceding/following flies are kept in contact with each other and some workshop desires a condition in which they are kept with a constant interval (interval between the preceding and following flies: 5 mm, 1 cm, . . . ). Even if a specification differs depending on a customer, this demand can be met by a simple adjustment. As for the adjustment for use, by adjusting the gap between the drive roller and the supporting roller in the carrying speed adjusting portion as described above, the interval between the preceding fly and the following fly can be adjusted. For example, when it is intended to sew flies in a condition in which a rear end of the preceding fly is kept in contact with a front end of the following fly, if the gap between the drive roller and the supporting roller is set close to the thickness of fabric, it becomes easy for the fly to get into the gap between both rollers. As a consequence, the interval between the preceding fly and the following fly decreases and as the gap between the drive roller and the supporting roller becomes smaller than the thickness of fabric of the fly, the interval between the preceding fly and the following fly increases.

Although this fly is often composed of a rectangular fabric piece, as described previously, a so-called curved fly is often used, this curved fly being produced by cutting a front end single side of the rectangular fabric piece into a curved shape. In such an ordinary rectangular fly, an edge of a long side portion on one side is serged in order to prevent a raveling, and in case of the curved fly, its edge from the aforementioned cut-out portion to its extension portion is also serged. As for the transportation of the flies based on a conventional art, as disclosed in JP-B No. 63-009878, in case of an ordinary rectangular fly, its serged portion is never sandwiched between the drive roller and the supporting roller, because an upper supporting roller is disposed such that it is located in a center of the fly. However, in case of the curved fly, the serged portion is sandwiched by both rollers during transportation even if an arrangement of the drive rollers and supporting rollers is changed, because the serged portion traverses with its front end curved.

However, in case of a fly on which a serging is done, a step is generated because the thicknesses of the serged portion and fabric portion are largely different. However, if the urging forces of respective supporting rollers to the drive rollers are equalized in the fly carrying portion as disclosed in JP-B No. 63-009878, particularly the curved flies cannot be carried in conditions in which they are arranged neatly, because it is difficult to synchronize the carrying speeds for the serged portion and the fabric portion of a single curved fly.

Contrary to this, according to the present invention, not only the same fly carrying portion as before is provided on the upstream side, but also a carrying speed adjusting portion in which the urging force of the supporting roller to the drive roller is set larger than the urging force in the fly carrying portion is provided on the downstream side. Therefore, the fly is carried aggressively with a strong nipping force when its serged portion passes, and after the serged portion passes, it is carried securely with the fabric portion nipped securely with the urging force by the supporting roller and the drive roller. As a result, loss due to slippage is eliminated, so that the flies can be carried securely with their arrangement condition maintained.

Further, according to the present invention, unless the flies are carried securely to the sewing machine in coincident with feeding speed of the drive rollers of the carrying speed adjusting portion, an interval between a preceding fly and a following fly cannot be kept constant. Thus, both the drive roller and supporting roller are knurled and peripheral surfaces of the rollers are coated with rubber or the like to form high friction surfaces. As a result, the flies can be carried securely at a feeding speed of the drive roller without any slippage. On the other hand, in the fly carrying portion, peripheral surfaces of the drive rollers are formed into a friction surface and the supporting rollers are formed to smooth rollers, so that a slippage occurs when the following fly makes contact with the preceding fly. That is, the peripheral surfaces of the drive rollers and supporting rollers of the fly carrying portion are of low friction surfaces while the peripheral surfaces of the drive roller and supporting roller of the carrying speed adjusting portion are of higher friction surfaces than those of the drive roller and supporting roller of the fly carrying portion.

DESCRIPTION OF THE PREFERRED EMBODIMENTS

Figure 1:
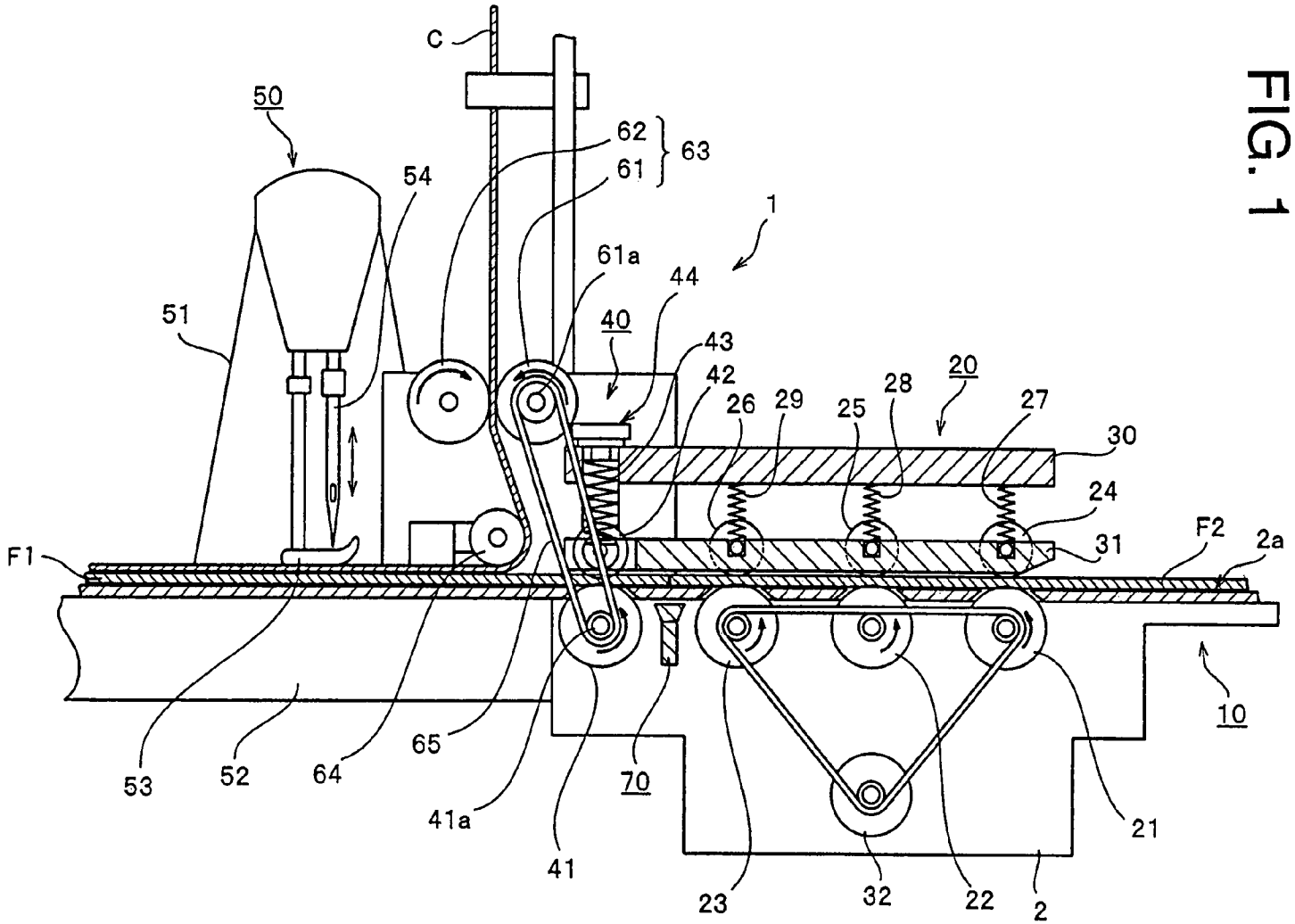
FIG. 1 is a longitudinal sectional view showing an outline of an entire structure of a fly sewing machine according to a typical embodiment of the present invention.

Hereinafter typical embodiments of the present invention will be explained in detail with reference to accompanying drawings. FIG. 1 is a side view showing schematically an entire structure of a fly sewing machine 1 according to an embodiment of the present invention.

The fly sewing machine 1 comprises, from an upstream side along a fly carrying passage 2*a* provided on a rack 2, a fly supply portion 10 for supplying a fly F, a fly carrying portion 20 for carrying the fly F supplied from the same fly supply portion 10 successively to a downstream side and a carrying speed adjusting portion 40 for feeding the fly F carried from the same fly carrying portion 20 to a sewing portion 50 on the downstream side at a predetermined timing. A chain feeding portion 60 for supplying a continuous long slide fastener chain C to the sewing portion 50 synchronously with sewing speed of the sewing portion 50 is disposed between the carrying speed adjusting portion 40 and the sewing portion 50.

In the fly supply portion 10, an upstream side end portion of the fly carrying passage 2*a* is constructed so as to extend to the upstream side from the fly carrying portion 20. According to this embodiment, a new fly F is fed manually to the fly supply portion 10 successively. Of course, it may be fed or introduced automatically by controlling and driving a feed roller (not shown) synchronously with the sewing speed.

The fly carrying portion 20 includes first to third drive rollers 21 to 23 disposed at a predetermined interval along the fly carrying passage, first to third supporting rollers 24 to 26 which are disposed so as to oppose to top portions of the respective drive rollers and rotate freely, first to third urging means 27 to 29 for urging elastically the respective supporting rollers 24 to 26 against the respective drive rollers 21 to 23 and upper and lower supporting frames 30, 31 for supporting the supporting rollers 24 to 26 against the drive rollers 21 to 23 such that they are capable of advancing or retracting. The first to third drive rollers 21 to 23 are supported rotatably by the rack 2 such that their carrying surfaces are exposed slightly above the fly carrying passage 2*a* of the rack 2 and these drive rollers 21 to 23 are driven at same speed by driving of a single drive motor 32 through a transmission belt 33. Each of the urging means 27 to 29 is composed of a compression spring according to this indicated example and its spring force is set to a weak range of 0.05 kgf-0.5 kgf.

Like the fly carrying portion 20, the carrying speed adjusting portion 40 comprises a fourth drive roller 41 supported rotatably by the rack 2, a fourth supporting roller 42 disposed above the driver roller 41 and supported rotatably by the upper and lower supporting frames 30, 31, fourth urging means 43 for urging elastically against the drive roller 41 and roller gap adjusting means 44 for adjusting a gap between the fourth drive roller 41 and the fourth supporting roller 42 by changing a lower limit position of the fourth supporting roller 42. The fourth driver roller 41 is driven so as to interlock with driving of chain feed rollers 61, 62 of the chain feeding portion 60, that is, the sewing operation of the sewing portion 50. In the meantime, rotation speed of the fourth drive roller 41 is set higher than sewing speed in the sewing portion 50. According to this embodiment, the rotation speed of the fourth drive roller 41 is increased by 10 to 15% with respect to the sewing speed. On the other hand, rotation speed of the first to third drive rollers 21 to 23 of the fly carrying portion 20 is set larger than the rotation speed of the fourth drive roller 41.

According to this embodiment, the peripheral surfaces of the first to third drive rollers 21 to 23 disposed on the fly carrying portion 20 are knurled and the peripheral surfaces of the first to third supporting rollers 24 to 26 are smooth surfaces. On the other hand, the peripheral surfaces of the fourth drive roller 41 and the fourth supporting roller 42 disposed in the carrying speed adjusting portion 40 are knurled.

According to this embodiment, a diameter of the fourth supporting roller 42 is set smaller than a diameter of the fourth drive roller 41. The diameter of the fourth drive roller 41 is set to 30 mm, the diameter of the fourth supporting roller 42 is set to 20 mm and the diameter of the fourth supporting roller 42 is set to ⅔ of the diameter of the fourth driver roller 41. The fourth urging means 43 uses a compression spring like the first to third urging means 27 to 29 of the fly carrying portion 20. According to this embodiment, the spring force of the compression spring as the fourth urging means 43 is set to a range of 2 kgf to 4 kgf and this spring has a spring force about 8 to 40 times higher than those of the springs of the urging means 27 to 29 of the fly carrying portion 20.

Thus, an urging force of the carrying speed adjusting portion 40 to the fourth supporting roller 42 becomes larger than an urging force of the fly carrying portion 20 to the first to third supporting rollers 24 to 26, and a gap d1 between the fourth drive roller 41 and the fourth supporting roller 42 does not vary compared with gaps between the first to third drive rollers 21 to 23 and the first to third supporting rollers 24 to 26 of the fly carrying portion 20, respectively. As stated above, with the urging forces applied to the first to fourth supporting rollers 24 to 26, 42, the first to fourth drive rollers 21 to 23, 41 and the first to fourth supporting rollers 24 to 26, 42 nip the fly F and rotate to carry the fly F.

Figure 2:
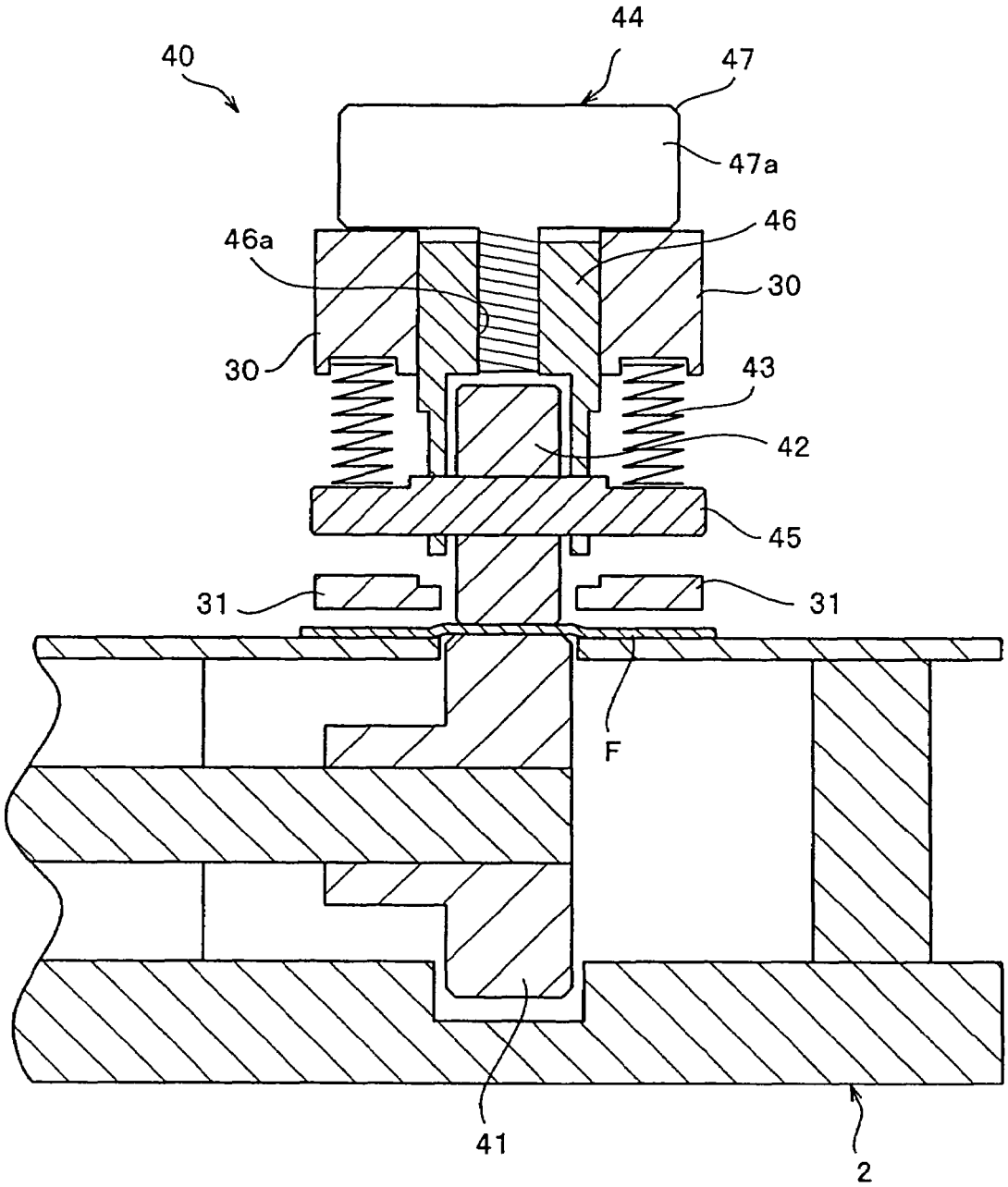
FIG. 2 is a lateral sectional view showing a structure of a carrying speed adjusting portion of the same sewing machine, which is a feature portion of the present invention in enlargement.
Figure 3:
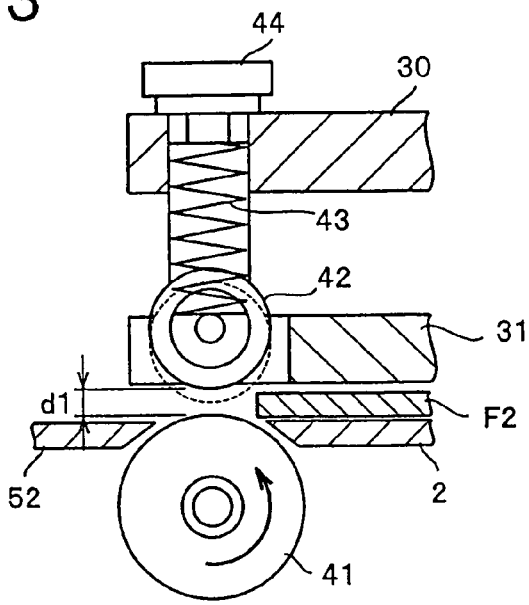
FIG. 3 is an explanatory diagram showing gap adjusting operation between a drive roller and a supporting roller of the same carrying speed adjusting portion.

As shown in FIG. 2 in enlargement, the roller gap adjusting means 44 comprises a supporting shaft 45 for supporting the fourth supporting roller 42 rotatably, a shaft supporting member 46 which supports right and left ends of the supporting shaft 45 non-rotatably and can slide vertically between right and left upper frames 30, and a dial provided adjusting screw 47 which engages a screw hole 46*a* formed in a central portion as seen in plan of the shaft supporting member 46 such that it goes through vertically. The compression springs having a strong spring force as the fourth urging means are mounted between the right and left upper frames 30 and right and left axial ends of the supporting shaft 45 fixed on the shaft supporting member 46. If a dial portion 47*a* is turned in its screwing direction as indicated with a solid line and dotted line of FIG. 3, the gap between the fourth drive roller 41 and the fourth supporting roller 42 is narrowed. If the dial portion 47*a* is turned in an opposite direction to the screwing direction, the gap between the fourth drive roller 41 and the fourth supporting roller 42 is expanded.

As shown in FIG. 1, the sewing portion 50 is disposed on the downstream side of the carrying speed adjusting portion 40. A sewing machine 51 is installed on this sewing portion 50. The sewing machine 51 comprises a supporting table 52, a pressing metal 53, a pair of sewing needles 54 for sewing the fly F to a slide fastener chain C and a feeding metal (not shown). The chain feeding portion 60 comprises a chain feed roller portion 63 for pulling the slide fastener chain C from a chain storage portion (not shown) disposed above the sewing machine 51 and feeding downward, wherein the chain feed roller portion 63 has a pair of chain feed rollers consisting of a drive roller 61 and a driven roller 62 which are disposed in a longitudinal direction and driven by an independent transmission drive motor (not shown). The drive roller 61 and the driven roller 62 rotate with the long long slide fastener chain C nipped between them. The chain feeding portion 60 also comprises a chain guide roller 64 disposed on the downstream side of a chain feeding passage. The slide fastener chain C fed downward from the feed roller portion 63 is converted in its direction by the chain guide roller 64 and carried between the pressing metal 53 of the sewing machine 51 and the fly F sent from the fly carrying passage 2*a*.

The fourth drive roller 41 of the carrying speed adjusting portion 40 and the drive roller 61 of the feed roller portion 63 are connected by transmission pulleys 41*a*, 61*a* thereof via a transmission belt 65. Thus, the fourth drive roller 41 of the carrying speed adjusting portion 40 is driven synchronously with the drive roller 61 of the feed roller portion 63. A diameter of the transmission pulley 41*a* of the fourth drive roller 41 is set smaller than a diameter of the transmission pulley 61*a* of the drive roller 61 of the feed roller portion 63. According to this embodiment, with a ratio between the diameter of the transmission pulley 41*a* of the fourth drive roller 41 and the diameter of the drive roller 61 of the feed roller portion 63 set to 50:56, feeding speed for the fly F in the carrying speed adjusting portion 40 is set higher by 10 to 15% than feeding speed of the slide fastener chain C, or the sewing speed of the sewing machine 51.

According to this embodiment, as shown in FIG. 1, a photoelectric detector 70 is installed below the fly carrying passage 2*a* between the fly carrying portion 20 and the carrying speed adjusting portion 40. If a fly F passes over detection area of this photoelectric detector 70 so that its beam is intercepted, the sewing machine 51 and the fourth drive roller 41 begin to be driven, so that an interval is generated between a preceding fly F1 and a following fly F2, and if beam passes between a beam projector and a beam receiver of the photoelectric detector 70, the sewing machine 51 and the fourth drive roller 41 are stopped. On the other hand, when the carrying speed adjusting portion 40 is also stopped, driving of the fly carrying portion 20 is maintained. That is, with the interval existing between the preceding fly F1 and the following fly F2, if the photoelectric detector 70 detects that the rear end of the preceding fly F1 passes the same photoelectric detector 70, sewing and carrying of the preceding fly which is being carried over the carrying speed adjusting portion 40 are stopped immediately and if the front end of the following fly F2 which is being carried without any interruption during this stoppage passes so as to intercept the photoelectric detector 70, the sewing and carrying of the preceding fly F1 are restarted promptly.

In this case, because the carrying speed of the following fly F2 is higher than the carrying speed of the preceding fly F1, the following fly F2 overtakes the preceding fly F1 by the time when the preceding fly F1 passes the carrying speed adjusting portion 40, so that a front end surface of the following fly F2 makes contact with a rear end surface of the preceding fly F1 as shown in FIG. 1. In this contact condition, the front end of the following fly F2 tries to ride over the rear end of the preceding fly F1 because the carrying speed of the following fly F2 exceeds the carrying speed of the preceding fly F1. However, because the spring force of compression spring for urging the first to third supporting rollers 24 to 26 of the fly carrying portion 20 is small and the peripheral surfaces of the first to third supporting rollers 24 to 26 are smooth, the following fly F2 slips between the first to third drive rollers 21 to 23 and the first to third supporting rollers 24 to 26, and thus, it does not ride over the preceding fly F1. Even if it rides over slightly, the following fly F2 collides with the peripheral surface of the fourth supporting roller 42 of the carrying speed adjusting portion 40, so that it is kept from advancing further. Thus, the carrying speed adjusting portion 40 is always passed by the preceding fly F1 ahead.

Figure 4:
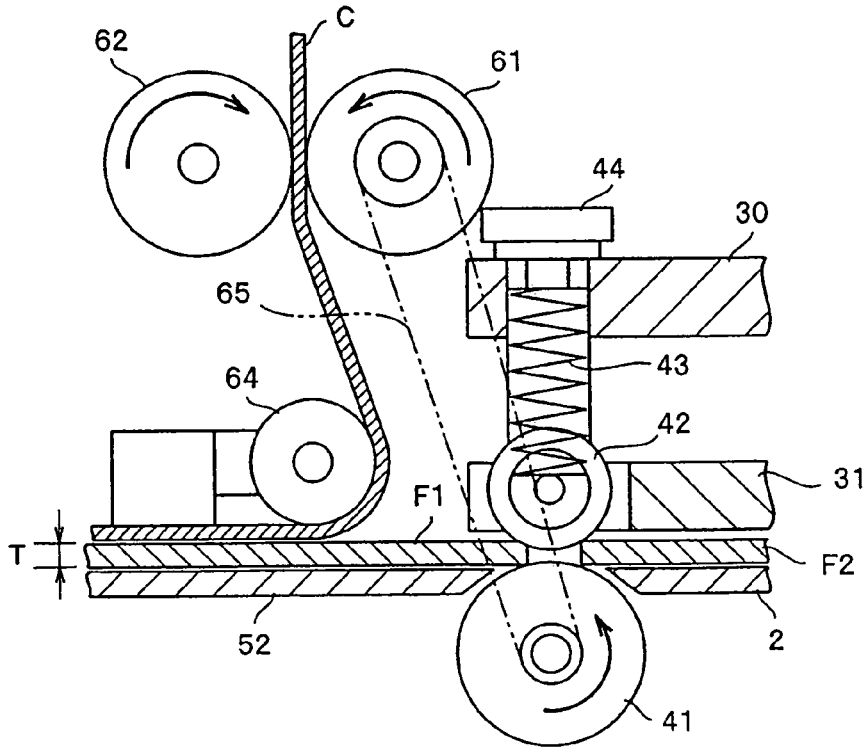
FIG. 4 is a longitudinal sectional view showing a first positional relation between a preceding fly and a following fly in the same carrying speed adjusting portion.
Figure 5:
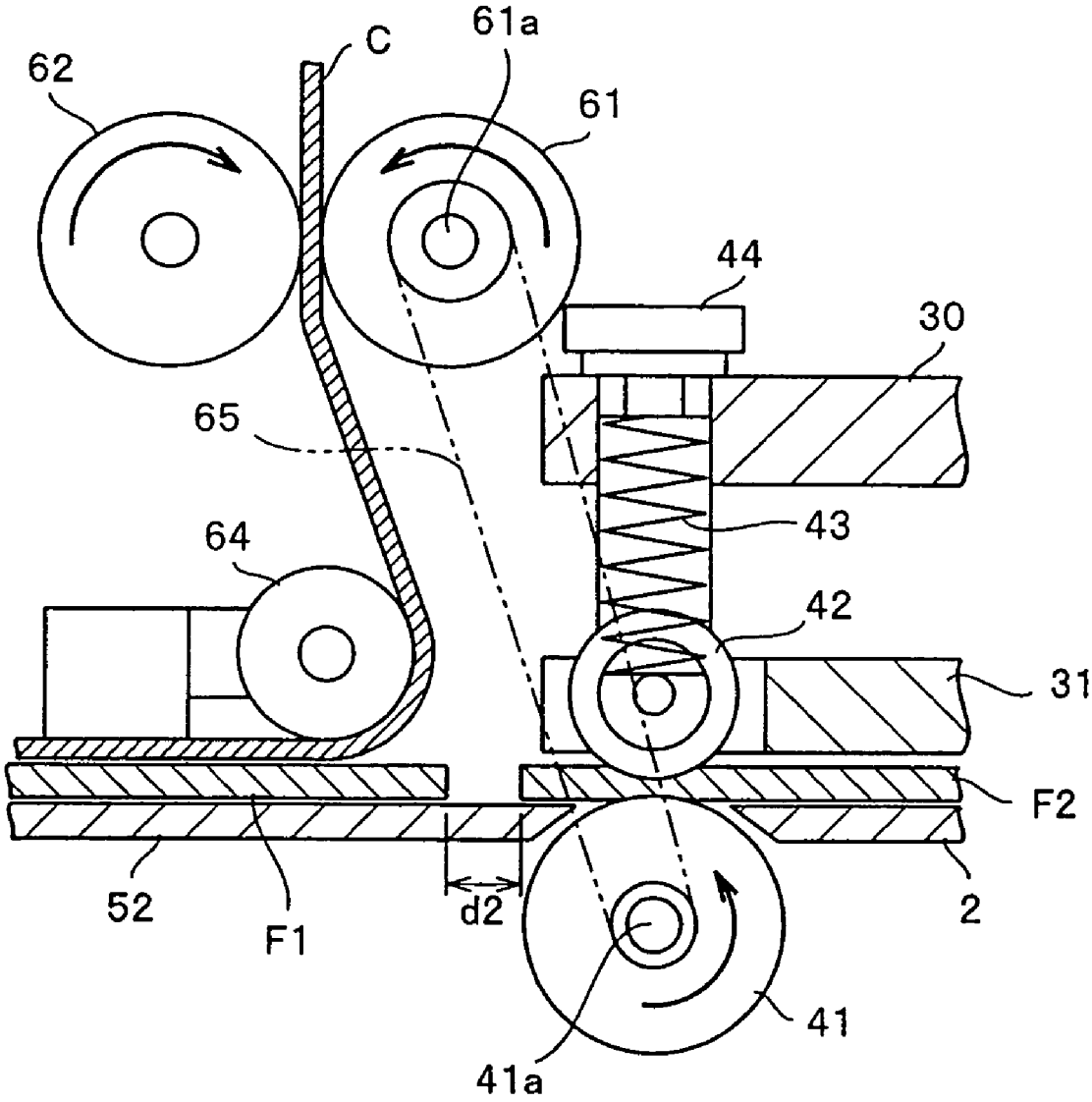
FIG. 5 is a longitudinal sectional view showing a second positional relation of the same.

Thereby, while the preceding fly F1 is being sewed to the slide fastener chain C by means of the sewing machine 51 with the front end of the following fly F2 being in contact with the rear end of the preceding fly F1, the front end of the following fly F2 makes contact with the peripheral surfaces of the fourth drive roller 41 and the fourth supporting roller 42 to aim at a gap between the respective rollers 41, 42 of the carrying speed adjusting portion 40, as shown in FIG. 4. In this case, because a size of the gap d1 between the fourth drive roller 41 and the fourth supporting roller 42 is smaller than a fabric thickness T of the following fly F2, the following fly F2 cannot instantly get into the gap between the respective rollers 41 and 42, so that it takes more or less time for the following fly F2 to get into the same gap. On the other hand, the preceding fly F1 is carried through the carrying speed adjusting portion 40 aggressively faster than the sewing speed by the sewing machine 51. As a result, as shown in FIG. 5, an interval d2 is generated between the preceding fly F1 and the following fly F2. The fly passing this carrying speed adjusting portion 40 between the fourth drive roller 41 and the fourth supporting roller 42 is carried securely because the peripheral surfaces of the fourth drive roller 41 and the fourth supporting roller 42 are knurled and further, the spring force of the compression spring is set larger than the spring force of the compression springs of the fly carrying portion 20.

The interval d2 at this time is not uniformly determined because it depends on a relation between the fabric thickness or plasticity of the fly F and the size of the gap d1 between the fourth drive roller 41 and the fourth supporting roller 42. Now, if the fly F is easily bitten into the gap between the fourth drive roller 41 and the fourth supporting roller 42, the flies F are carried through the carrying speed adjusting portion 40 such that the following fly F2 is kept in contact with the preceding fly F1 and as a consequence, the flies F may be fed to the sewing portion 50 in a condition in which the front end of the following fly F2 is riding over the rear end of the preceding fly F1, because the carrying speed of the carrying speed adjusting portion 40 is higher than the sewing speed and a nipping force between the fourth drive roller and the fourth supporting roller 42 for the fly F on the carrying speed adjusting portion 40 is extremely large. On the other hand, if the gap between the fourth drive roller 41 and the fourth supporting roller 42 is too large, it takes too long for the fly F to be bitten into the gap between the fourth drive roller 42 and the fourth supporting roller 42, so that the interval d2 between the preceding fly F1 and the following fly F2 is too large and thus, a desired interval cannot be obtained.

The interval between the preceding fly F1 and the following fly F2 varies depending on a desire of sewing manufacturer, for example, some manufacturer desires a condition in which the preceding fly F1 and the following fly F2 are kept in contact with each other and some manufacturer desires to keep a specified interval between the preceding fly F1 and the following fly F2. Therefore, sewing manufacturers have highly requested that the adjustment of the gap should be executed easily. According to the present invention, the adjustment of the gap between the fourth drive roller 41 and the fourth supporting roller 42 can be executed easily only by turning the aforementioned dial portion 47*a* of the carrying speed adjusting portion 40.

Figure 6:
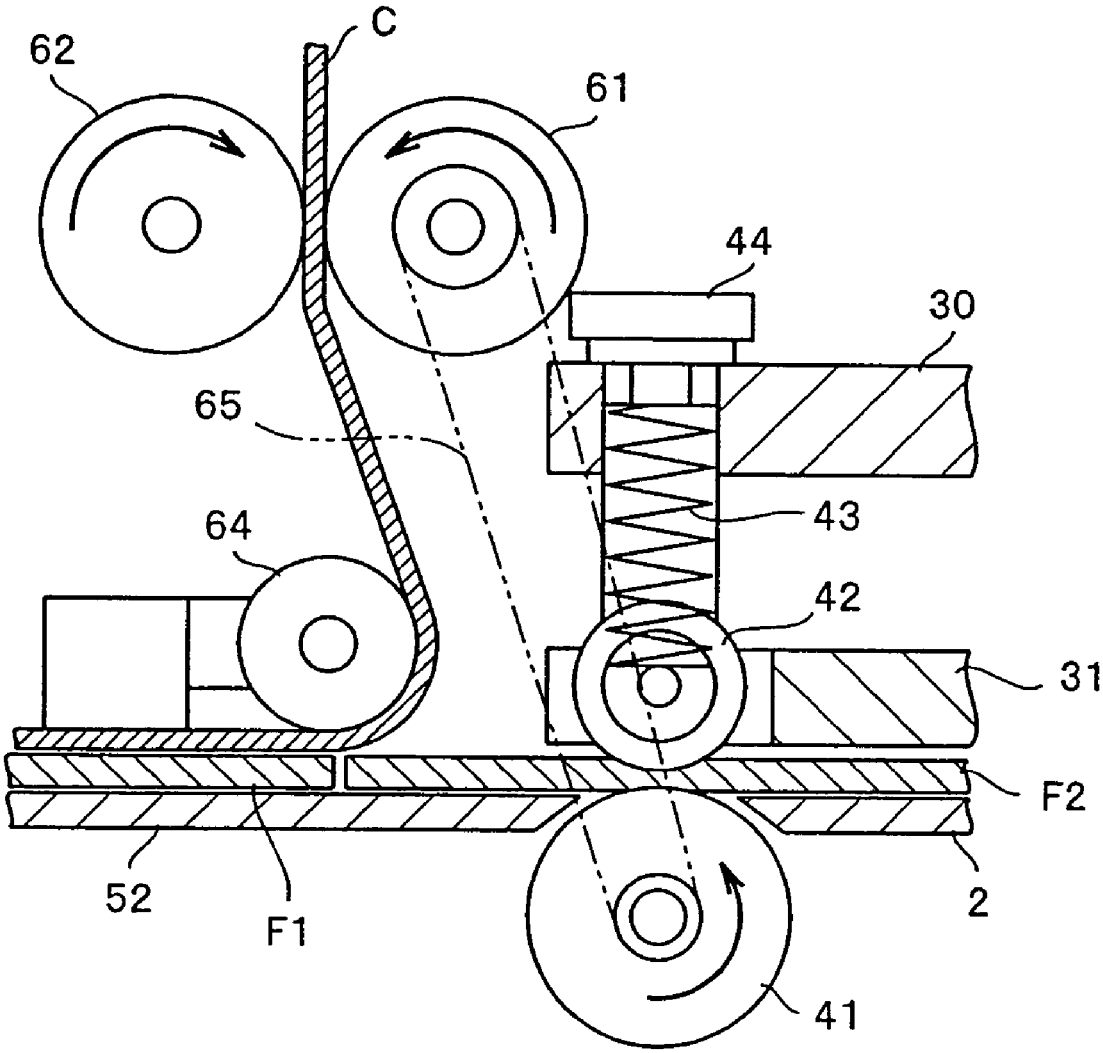
FIG. 6 is a longitudinal sectional view showing a third positional relation of the same.
Figure 7B:
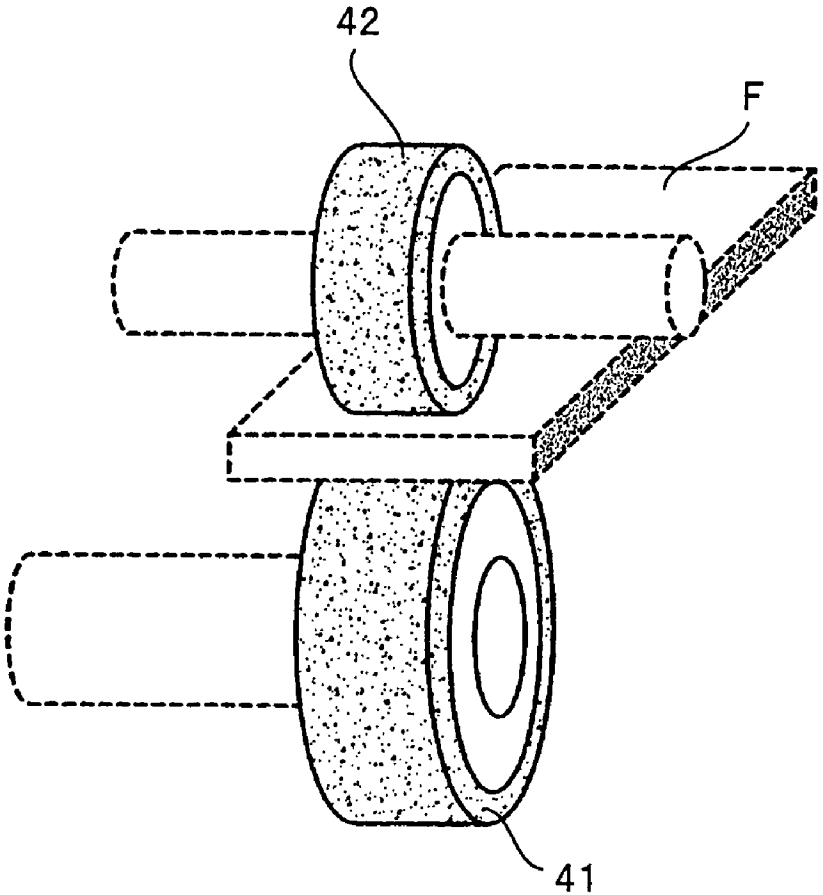
FIGS. 7A and 7B are perspective view showing peripheral surface structures of the drive roller and supporting roller of the same carrying speed adjusting portion.
Figure 7A:
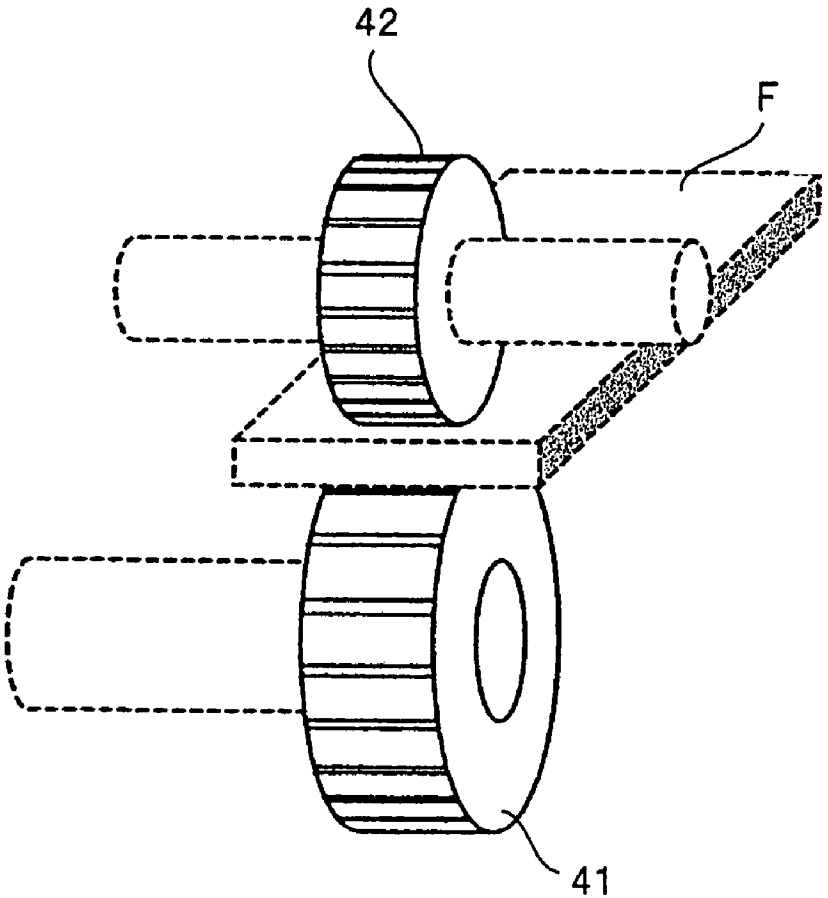

If the following fly F2 is bitten into the gap between the fourth drive roller 41 and the fourth supporting roller 42, the following fly F2 runs after the preceding fly F1 being sewed by an amount that the driving speed of the fourth drive roller 41 exceeds the drive speed of the sewing machine 51, so that as shown in FIG. 6, it is introduced between a slide fastener chain guided by the chain roller 64 and the supporting table 52. At this time, a final interval between the preceding fly F1 and the following fly F2 can be adjusted arbitrarily by suitably selecting a ratio between the sewing speed of the sewing machine 51 and the drive speed of the fourth drive roller 41. A slip is likely to occur although it is slight in carrying the fly F by the fourth drive roller 41 and the fourth supporting roller 42, so that the aforementioned final interval changes. Thus, according to this embodiment, as shown in FIG. 7A, the peripheral surfaces of the fourth drive roller 41 and the fourth supporting roller 42 are knurled or as shown in FIG. 7B, the peripheral surfaces of both the rolls 41, 42 are covered with material having a high friction coefficient like rubber. On the other hand, because the first to third drive rollers 21 to 23 and supporting rollers 24 to 26 need to slip as described before, they are constituted of smooth rollers whose peripheral surfaces are smoothed.

Figure 8A:
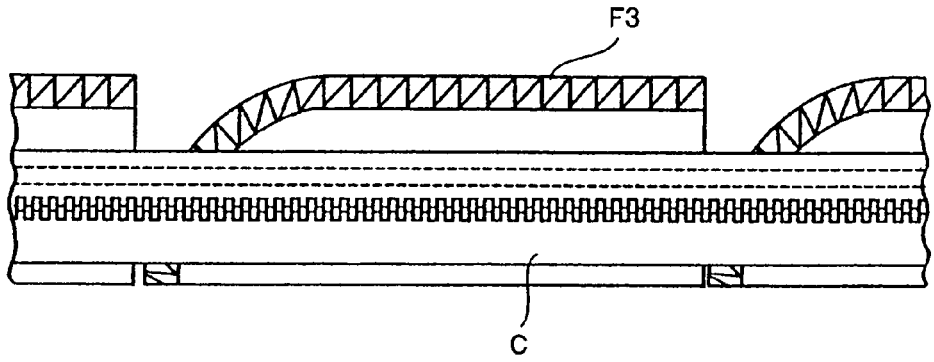
FIGS. 8A and 8B are partial plan view of a slide fastener chain on which flies having a different shape are sewed continuously.
Figure 8B:
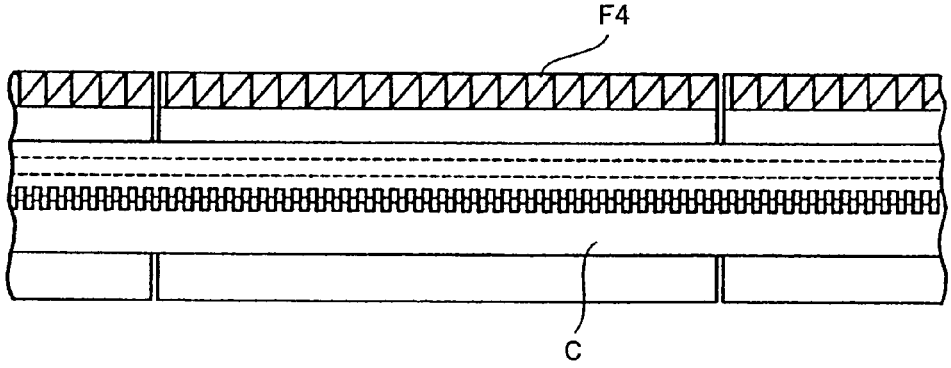

As a fly used for trousers in recent years, a fly F3 cut into a shape projecting outward by curving an end section of a rectangular fabric piece as shown in FIG. 8A is often used. Of course, a fly F4 composed of simple rectangular fabric piece as shown in FIG. 8B is often used for other purposes than the trousers. These flies F3 and F4 are usually serged. In the aforementioned fly F3 having a curved portion at an end thereof, the curved portion and its extension portion are serged while in case of the fly F4 having a simple rectangular shape, an edge portion of its long side portion is serged. In such serged fly F, a difference of height is generated between the serged portion and a main body of fabric piece, thereby producing a step.

Because of this step, if the flies F are sewed continuously to the slide fastener chain C by means of the sewing machine 1, the fly F4 having a rectangular shape shown in FIG. 8B is nipped by the first to fourth drive rollers 21 to 23, 41 and the supporting rollers 24 to 26, 42 by avoiding its serged portion, so as to reduce an influence of the step. On the other hand, in case of the fly F3 having a curved portion at an end thereof shown in FIG. 8A, when the fly F3 is carried, the supporting rollers 24 to 26, 42 need to surpass the step between the serged portion and fabric main body, because the curved portion of the fly F3 traverses an entire length in a width direction of the fly F3. At a time of surpassing this step, if the nipping force of the supporting rollers and the drive rollers for the fly F3, that is, elastic urging force by the supporting rollers against the drive rollers is weak like an ordinary sewing machine, the carrying speed changes instantaneously and therefore, accurate carrying is disabled.

Because the sewing machine 1 of the present invention carries the fly F3 through the carrying speed adjusting portion 40 at a final stage for feeding the fly F3 to the sewing machine, the fly F3 nipped with a strong elastic force by the fourth drive roller 41 and the fourth supporting roller 42 is carried with its serged portion crushed and following fabric main body pressed with an appropriate force so as to eliminate the influence of the step. As a result, even the curved fly F3 having a curved edge at an end thereof, which cannot be carried according to a conventional art, can be fed to the sewing machine 51 under an accurate speed control, so that a predetermined interval between the flies is maintained by turning the aforementioned dial portion 47*a*.

What is claimed is:

1. A fly sewing machine for sewing plural flies made of fabric piece to a long slide fastener chain continuously, comprising:

a fly carrying portion disposed on an upstream side of a fly carrying passage between a fly supply portion and a sewing portion and a carrying speed adjusting portion disposed on a downstream side, wherein the fly carrying portion comprises plural pairs of carrying rollers including drive rollers and supporting rollers disposed vertically so as to oppose to each other, the carrying speed adjusting portion comprises a pair of a drive roller and a supporting roller disposed vertically and roller gap adjusting means for adjusting a gap between the drive roller and the supporting roller, and wherein a carrying speed for the fly carrying portion by each pair of the carrying rollers is the same, a carrying speed of the carrying speed adjusting portion is set lower than the carrying speed of the fly carrying portion, and a sewing speed of the sewing portion is set lower than the carrying speed of the carrying speed adjusting portion.

2. The fly sewing machine according to claim 1, wherein the supporting rollers of the fly carrying portion and the supporting roller of the carrying speed adjusting portion are elastically urged against the opposing drive rollers respectively, and an urging force of the carrying speed adjusting portion to the supporting roller is set to 8 to 40 times as large as an urging force of the fly carrying portion to the supporting rollers.

3. The fly sewing machine according to claim 1, wherein a photoelectric detector for maintaining drive of the sewing portion when beam is intercepted and stopping the drive of the sewing portion when the beam is transmitted is disposed between the fly carrying portion and the carrying speed adjusting portion.

4. The fly sewing machine according to claim 1, wherein a diameter of the drive roller in the carrying speed adjusting portion is set larger than a diameter of the supporting roller in the carrying speed adjusting portion.

5. The fly sewing machine according to claim 1, wherein peripheral surfaces of the drive rollers and the supporting rollers in the fly carrying portion are low friction surfaces while peripheral surfaces of the drive roller and the supporting roller of the carrying speed adjusting portion are higher friction surfaces as compared with the drive rollers and the supporting rollers of the fly carrying portion.

6. The fly sewing machine according to claim 1, wherein the roller gap adjusting means can adjust the gap between the drive roller and the supporting roller of the carrying speed adjusting portion so as to be smaller than a fabric thickness of the fly.

7. The fly sewing machine according to claim 1, wherein a chain feeding portion for feeding the long slide fastener chain to the sewing portion is disposed between the carrying speed adjusting portion and the sewing portion, the chain feeding portion comprises a chain feed roller portion having a drive roller for supplying and sending the long slide fastener chain, and the drive roller of the carrying speed adjusting portion is driven and rotated synchronously with a drive of the drive roller of the chain feed roller portion.

* * * * *